US009470378B2

(12) United States Patent
Kim

(10) Patent No.: US 9,470,378 B2
(45) Date of Patent: Oct. 18, 2016

(54) LED LAMP

(71) Applicant: Jong-Chen Kim, Bucheon-si (KR)

(72) Inventor: Jong-Chen Kim, Bucheon-si (KR)

( * ) Notice: Subject to any disclaimer, the term of this patent is extended or adjusted under 35 U.S.C. 154(b) by 145 days.

(21) Appl. No.: 14/104,894

(22) Filed: Dec. 12, 2013

(65) Prior Publication Data

US 2014/0168991 A1 Jun. 19, 2014

(30) Foreign Application Priority Data

Dec. 14, 2012 (KR) ..... 10-2012-0146526

(51) Int. Cl.

| | |
|---|---|
| ***F21K 99/00*** | (2016.01) |
| ***F21V 15/01*** | (2006.01) |
| ***F21V 15/015*** | (2006.01) |
| ***F21V 17/02*** | (2006.01) |
| ***F21V 29/507*** | (2015.01) |

(52) U.S. Cl.
CPC ..... *F21K 9/30* (2013.01); *F21V 15/013* (2013.01); *F21V 15/015* (2013.01); *F21V 17/02* (2013.01); *F21V 29/507* (2015.01)

(58) Field of Classification Search
CPC ..... F21V 15/015; F21V 17/002
See application file for complete search history.

(56) References Cited

U.S. PATENT DOCUMENTS

| | | | | |
|---|---|---|---|---|
| 5,176,441 | A * | 1/1993 | Horvath dr.nee Vegh | H01K 1/34 362/267 |
| 6,425,681 | B1 * | 7/2002 | Agabekov | F21V 3/00 362/223 |
| 7,766,510 | B2 * | 8/2010 | Lee | F21S 48/328 362/249.02 |
| 7,950,821 | B1 * | 5/2011 | Georgitsis et al. | 362/217.12 |
| 8,025,422 | B1 * | 9/2011 | Huang et al. | 362/241 |
| 8,322,881 | B1 * | 12/2012 | Wassel | F21V 7/00 362/217.05 |
| 2007/0047229 | A1 * | 3/2007 | Lee | F21V 5/04 362/237 |
| 2007/0070628 | A1 * | 3/2007 | Chen | F21S 9/03 362/249.01 |
| 2011/0063844 | A1 * | 3/2011 | Swafford et al. | 362/249.02 |
| 2012/0069568 | A1 * | 3/2012 | Bianco et al. | 362/243 |
| 2012/0262091 | A1 * | 10/2012 | Maglica | F21L 4/005 315/307 |

FOREIGN PATENT DOCUMENTS

| | | |
|---|---|---|
| KR | 20080039847 | 5/2008 |
| KR | 20110011191 | 2/2011 |
| KR | 20120086643 | 8/2012 |
| KR | 20120095432 | 8/2012 |
| WO | WO2012/139311 | * 10/2012 |

* cited by examiner

*Primary Examiner* — Anh Mai
*Assistant Examiner* — Zachary J Snyder
(74) *Attorney, Agent, or Firm* — IPLA P.A.; James E. Bame

(57) ABSTRACT

Provided is an LED lamp in which a lens for diffusing light from an LED can be received in and fixed to a reflector without interfering with the outer side of the lens. The LED lamp of the present invention includes a lamp unit configured to emit light; a lamp housing unit configured to have the lamp unit embedded in the lamp housing unit and to have the front opened so that the light of the lamp unit is scanned to the front; a front cover unit fixed in front of the lamp housing unit and configured to have the inside hollowed; and glass fixed in front of the lamp housing unit by means of the front cover unit and configured to transmit the light of the lamp unit.

9 Claims, 8 Drawing Sheets

LED LAMP

CROSS REFERENCE

The present application claims the benefit of Korean Patent Application No. 10-2012-0146526 filed in the Korean Intellectual Property Office on Dec. 14, 2012, the entire contents of which are incorporated herein by reference.

BACKGROUND OF THE INVENTION

1. Field of the Invention

The present invention relates to an LED lamp in which a lens for diffusing light from an LED can be received in and fixed to a reflector without interfering with the outer side of the lens.

2. Background of the Related Art

In general, an LED lighting apparatus is for discharging light emitted from an LED and is used for indoor use and outdoor use.

A conventional LED lens holder (Korean Patent Registration No. 20-0449951) related to the present invention has been registered with Korean Intellectual Property Office.

A conventional LED lighting apparatus is configured to include a housing, a circuit board embedded in the housing, an LED mounted on the circuit board and configured to emit light, a lens configured to diffuse light from the LED and to have a fixed hook formed on the outside thereof, and a holder body configured to reflect the light of the LED which is diffused by the lens and to have an insertion hole to which the fixed hook of the lens is detachably fixed formed therein.

Accordingly, the lens can be fixed to the reflection member by tightly fitting the fixed hook of the lens into the insertion hole in the state in which the holder body has been fixed to the circuit board so that the light of the LED is reflected.

However, the lens is problematic in that light diffused by the lens is lost through a protrusions and the insertion hole because the protrusions is integrally formed on the outside of the lens.

Furthermore, there is a problem in that an external appearance is not beautiful because the protrusions and the insertion hole are exposed to the front of the holder body.

SUMMARY OF THE INVENTION

An object of the present invention is to provide an LED lamp in which a lens for diffusing light from an LED can be received in and fixed to a reflector without interfering with the outer side of the lens and a fixed structure for fixing the lens is not exposed to the front of a reflector.

The present invention provides an LED lamp, including a lamp unit configured to emit light; a lamp housing unit configured to have the lamp unit embedded in the lamp housing unit and to have the front opened so that the light of the lamp unit is scanned to the front; a front cover unit fixed in front of the lamp housing unit and configured to have the inside hollowed; and glass fixed in front of the lamp housing unit by means of the front cover unit and configured to transmit the light of the lamp unit. Here, the lamp housing unit includes fitting grooves formed in the outer circumferential surface of the rear and front ends of a housing member in the opened front of the lamp housing unit and inside support jaws configured to support the inner side of the glass and protruded toward the internal space of the lamp housing unit. Furthermore, the front cover unit includes cover jaws configured to cover the rear and front ends of the housing member in the opened front of the lamp housing unit, protrusions detachably fixed to the respective fitting grooves of the lamp housing unit and formed in the inner circumferential surface of the cover jaw, and outside support jaws configured to support the outer side of the glass supported by the inside support jaws.

The lamp unit preferably includes a circuit board configured to have LEDs mounted on the circuit board with the LEDs connected to a surface of the circuit board; reflectors each configured to include a reflection surface fixed to the circuit board so that the LED of the circuit board is placed at the rear end of the reflector in such a way as to penetrate the reflector and configured to reflect the light of the LED and a holder mounting hole formed at the front end of the reflection surface; lenses each inserted into the reflector and configured to diffuse the light of the LED with the lens closely adhered to the LED; and holders each inserted into the holder mounting hole of the reflector in the state in which the holder pressurizes the front end of the lens in order to prevent the lens from being detached from the reflector and configured to reflect the light of the LED which is diffused by the lens along with the reflector.

DETAILED DESCRIPTION OF THE INVENTION

Hereinafter, an LED lamp in accordance with an exemplary embodiment of the present invention is described in detail with reference to the accompanying drawings.

Figure 1:
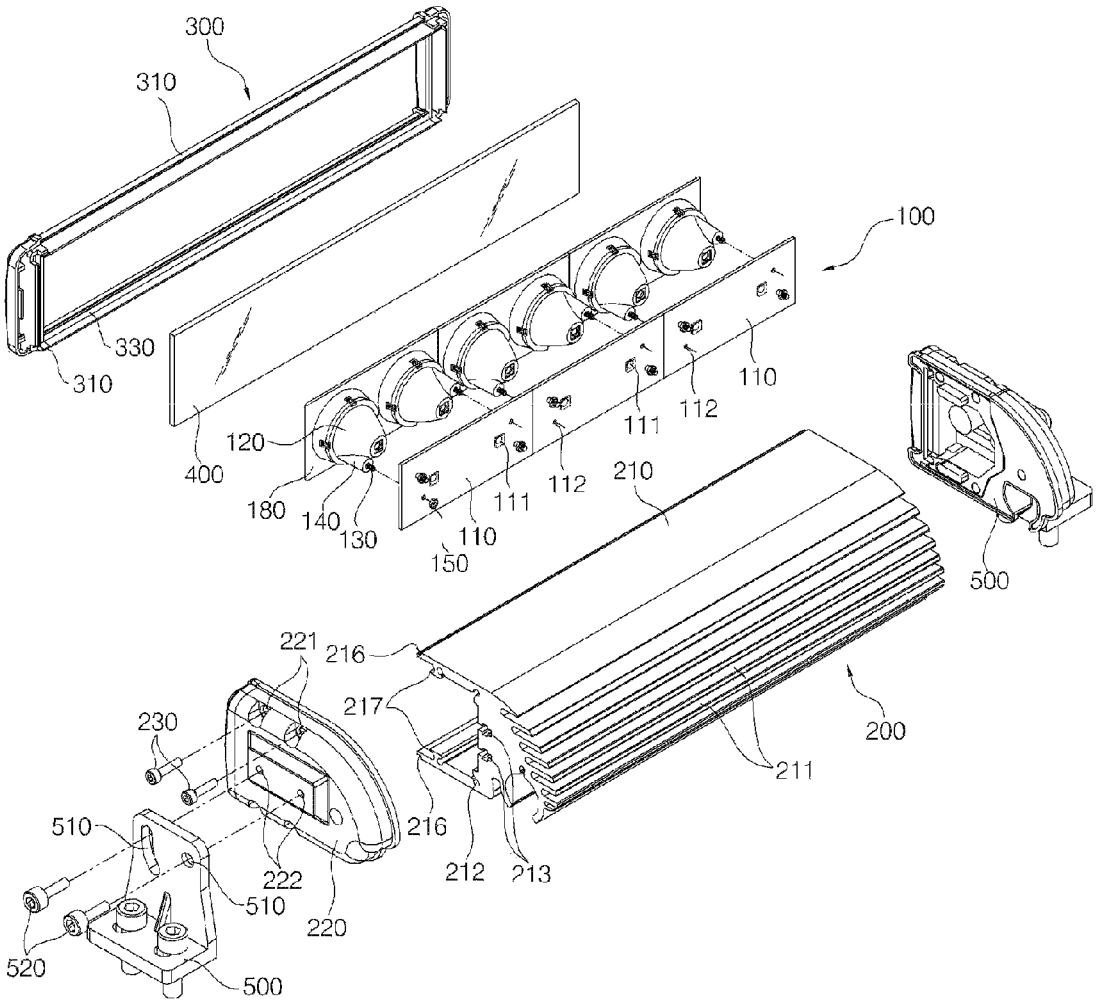
FIG. 1 is an exploded perspective view of the LED lamp in accordance with an embodiment of the present invention.
Figure 2:
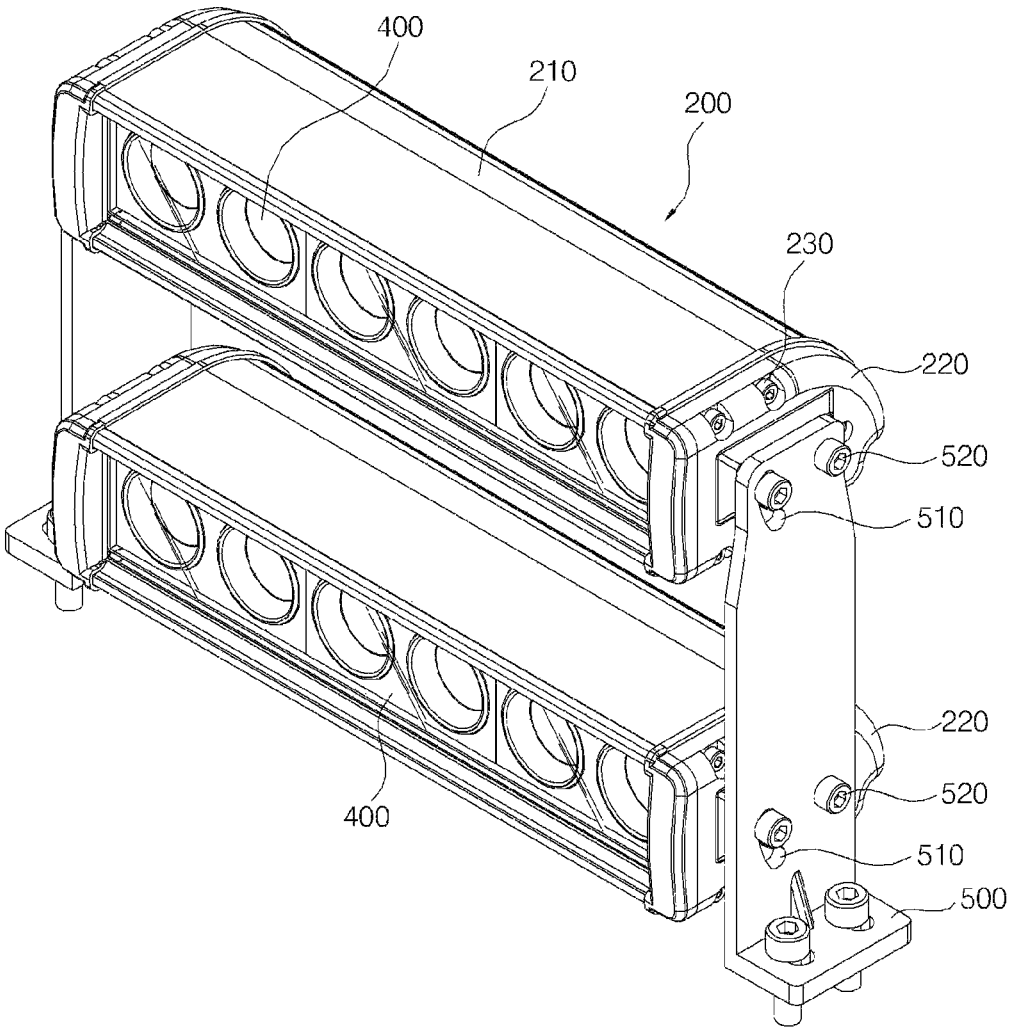
FIG. 2 is a perspective view of the LED lamp in accordance with an embodiment of the present invention.
Figure 3:
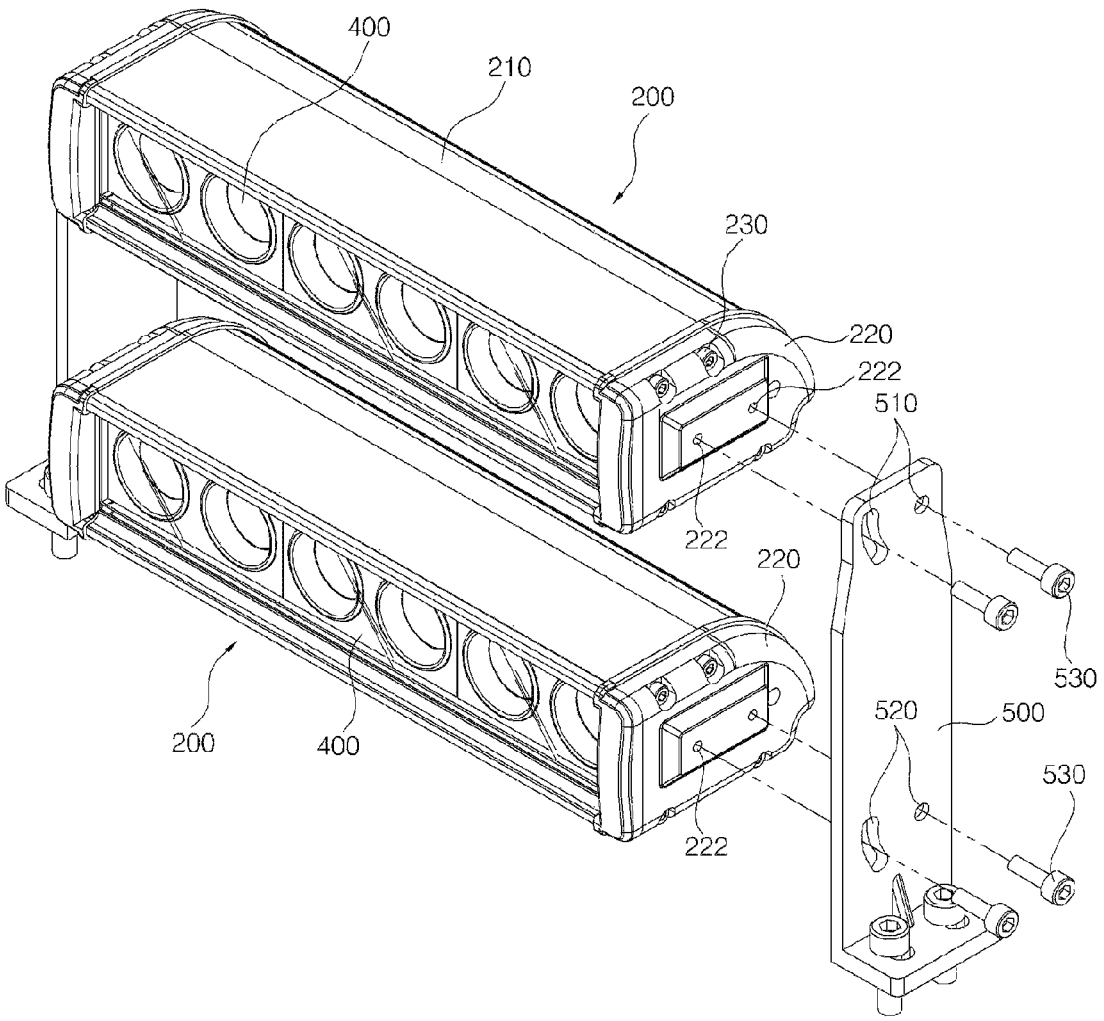
FIG. 3 is an exploded perspective view of the LED lamp of FIG. 2.
Figure 4:
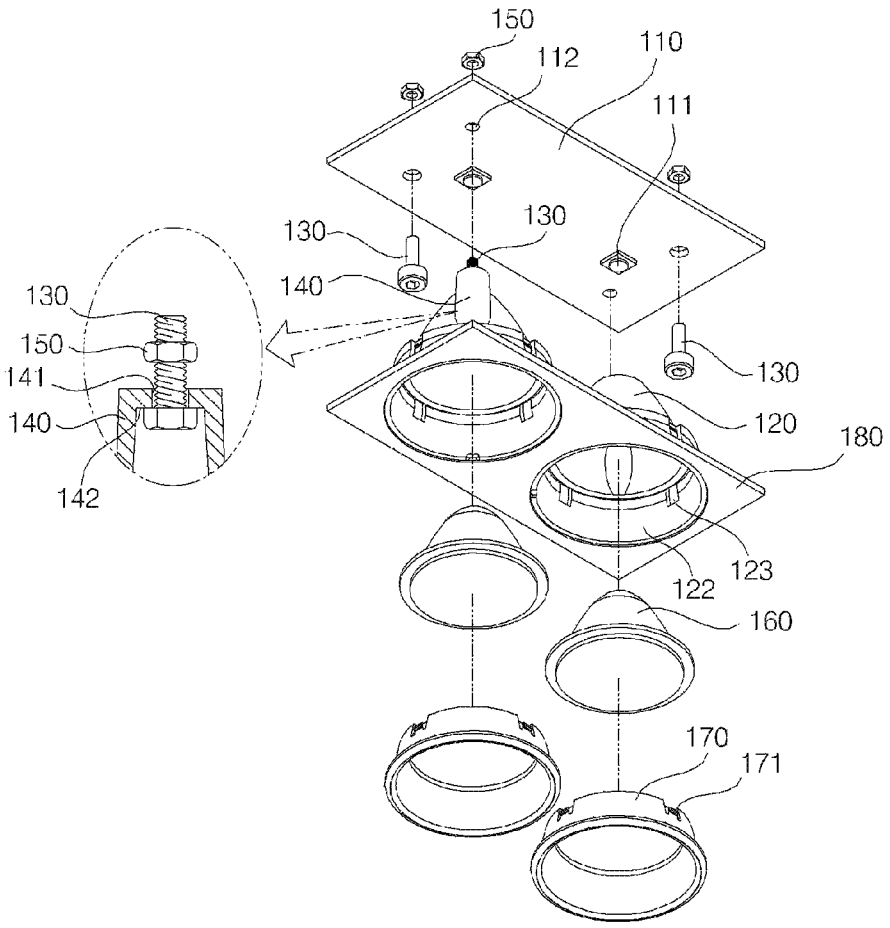
FIG. 4 is an exploded perspective view showing major elements of the LED lamp according to the present invention.
Figure 5:
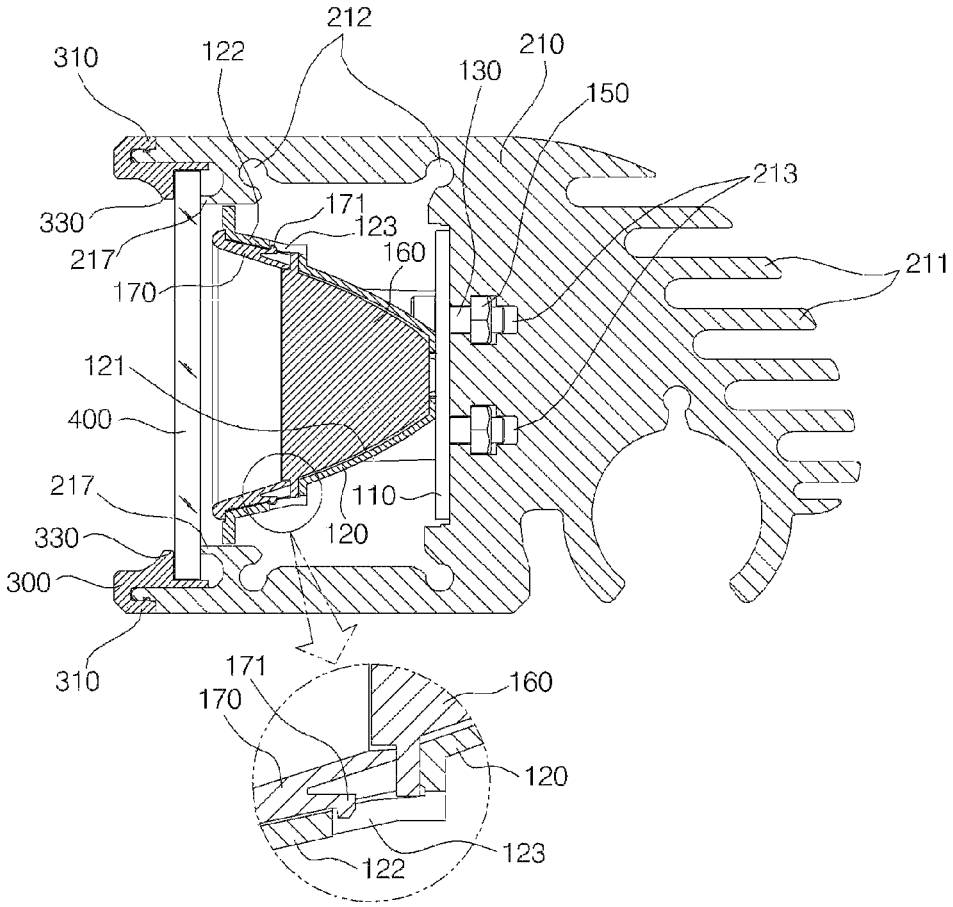
FIG. 5 is a cross-sectional view showing a state in which a lamp unit has been installed in a lamp housing unit that is applied to the present invention.
Figure 6:
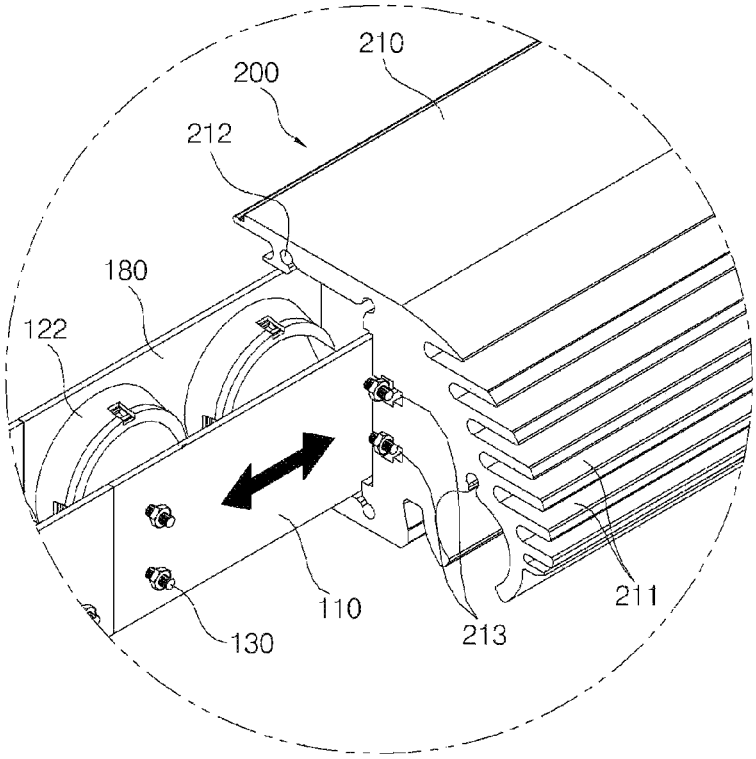
FIG. 6 is a perspective view showing a state in which the lamp unit has been inserted into the lamp housing unit of the present invention.
Figure 7:
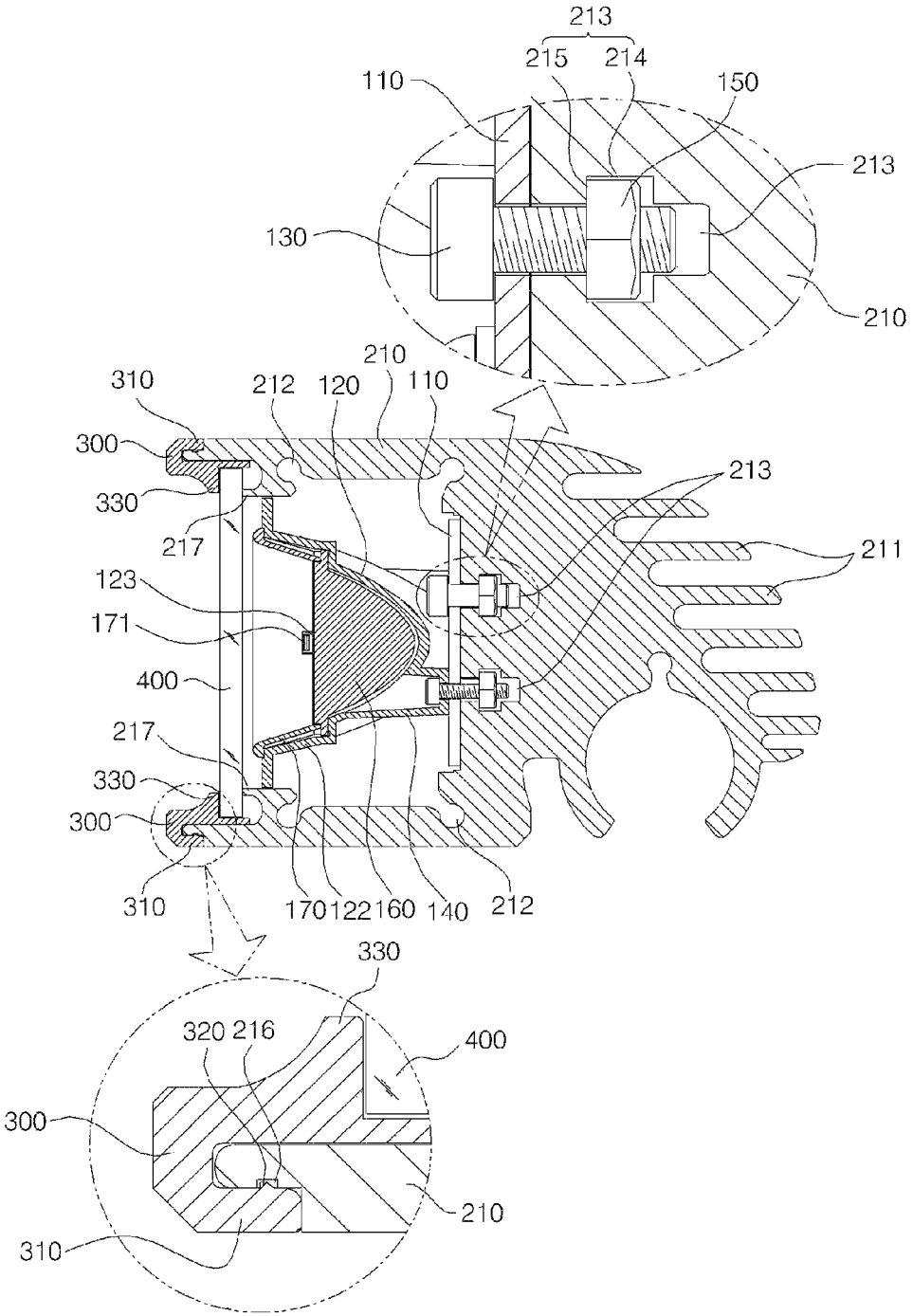
FIG. 7 is a cross-sectional view showing the inside of a bolt reception tubes that is applied to the present invention.

As shown in FIGS. 1 and 2, the LED lamp include a lamp unit 100 configured to emit light, a lamp housing unit 200 configured to have the lamp unit 100 embedded therein and to have the front opened so that the light of the lamp unit 100 is scanned to the front, a front cover unit 300 fixed in front of the lamp housing unit 200 and configured to have the inside hollowed, and glass 400 fixed in front of the lamp housing unit 200 by means of the front cover unit 300 and configured to transmit the light of the lamp unit 100.

As shown in FIGS. 4 to 7, the lamp unit 100 includes a circuit board 110, reflectors 120, bolt members 130, bolt reception tubes 140, nut members 150, conical lenses 160, and holders 170.

The circuit board 110 has LEDs 111 mounted thereon with the LEDs 111 connected to a surface of the circuit board 110 and has board screw taps 112 formed in the circuit board 110 in such a way as to penetrate the circuit board 110. Each of the reflectors 120 is fixed to the circuit board 110 so that the LED 111 formed in the circuit board 110 is placed at the rear end of the center of the reflector 120 in such a way as to penetrate the reflector 120.

The reflector 120 has a narrow upper part and a wide lower part, has a reflection surface 121 for reflecting the light of the LED 111 formed therein, and has a holder mounting hole 122 formed at the front end of the reflection surface 121. The bolt members 130 are screwed onto the board screw taps 112 of the circuit board 110 so that the reflectors 120 are installed in the circuit board 110.

Each of the bolt reception tubes 140 is eccentrically penetrated on the outside of the reflector 120 and is configured to have the bolt member 130 inserted therein from the inside of the reflector 120 to the outside thereof. A shaft hole 141 through which the screw shaft of the bolt member 130 penetrates is formed in the bolt reception tube 140. Furthermore, a bolt jaw 142 to which the head of the bolt member 130 is fitted is formed on the outside of the shaft hole 141.

Each of the nut members 150 is configured to penetrate the shaft hole 141 of the bolt reception tube 140 and is inserted into the lamp fixing groove 213 of a housing member 210 and fixed thereto in the state in which the nut member 150 has been screwed onto the screw shaft of the bolt member 130 screwed onto the board screw tap 112 of the circuit board 110. Each of the lenses 160 diffuses light from the LED 111 in the state in which the lens 160 has been inserted into the reflector 120 and closely adhered to the LED 111.

Each of the holders 170 is inserted into the holder mounting hole 122 of the reflector 120 in the state in which the holder 170 pressurizes the front end of the lens 160 in order to prevent the lens 160 from being detached from the reflector 120 and is configured to reflect the light of the LED 111 which is diffused by the lens 160 along with the reflector 120.

The LED 111 can be placed at the center of the lens 160 in the latter part of the lens 160 because the bolt reception tube 140 is eccentrically formed on the outside of the reflector 120 as described above. Furthermore, since one bolt member 130 is coupled to the board screw tap 112 in the state in which the bolt member 130 has been received in the bolt reception tube 140, the reflector 120 can be fixed to the circuit board 110. Accordingly, a task for fixing the reflector 120 to the circuit board 110 can be easily performed. Furthermore, the elastic protrusions 171 of the holder 170 can be detachably fixed to the fixed holes 123 of the reflector 120 in a one-touch manner easily and rapidly. Here, the holder 170, together with the lens 160, can forwardly reflect the light of the LED 111 by means of reflection paints coated and deposited on the inner circumferential surface of the holder 170.

In particular, since the elastic protrusions 171 are formed in the outer circumferential surface of the holder 170, a fine view can be provided because the elastic protrusions 171 are not exposed on the front of the holder 170 and the light of the LED 111 can be reflected without being lost by way of the inner circumferential surface of the holder 170.

Furthermore, the circuit board 110 to which the reflectors 120 have been fixed can be fixed to the lamp housing unit 200 because the nut members 150 screwed onto the bolt members 130 are inserted into the lamp fixing grooves 213 of the lamp housing unit 200.

The elastic protrusions 171 may be formed in the outer circumferential surface of the holder 170. The fixed holes 123 to which the elastic protrusions 171 of the holder 170 are detachably fixed can be formed in the holder mounting hole 122 of the reflector 120 in such a way as to laterally penetrate the holder mounting hole 122. The holder 170 can be inserted into the holder mounting hole 122 of the reflector 120 easily and rapidly in a one-touch manner because the elastic protrusions 171 is detachably fixed to the fixed holes 123. Furthermore, light diffused by the lens 160 can be fully reflected from the reflection surface 121 of the reflector 120 without being lost outside the lens 160 because the elastic protrusions 171 and the fixed holes 123 combined together are spaced apart from the lens 160.

Furthermore, the lamp unit 100 further includes one or more socket fixing plates 180 to each of which the front ends of two or more reflectors 120 are fixed in such a way as to penetrate the socket fixing plate 180. The reflector 120 may be rotated around one bolt member 130 in the state in which the reflector 120 has been fixed to the circuit board 110 by means of the one bolt member 130, but two reflectors 120 can be prevented from being rotated around the bolt member 130 because the two reflectors 120 are fixed to the socket fixing plate 180. Furthermore, both ends of each of the socket fixing plate 180 can be stably supported by lateral members 220 fixed to both sides of the housing member 210. Furthermore, the socket fixing plate 180 may be integrally formed at the front end of the reflector 120 by way of forming using a mold.

The lamp housing unit 200 includes the housing member 210, lateral members 220, and lateral screws 230.

The housing member 210 extends along with the opened front and has an internal space formed therein. The housing member 210 includes heat dissipation pins 211 backwardly protruded from the housing member 210, lateral screw holes 212 configured to have female threads formed on the side thereof, lamp fixing grooves 213 formed laterally from the housing member 210 and configured to have the nut members 150 inserted therein and fixed thereto, fitting grooves 216 formed in the outer circumferential surface of the rear and front ends of a housing member 210 in the opened front thereof, and inside support jaws 217 configured to support the inner side of the glass 400 and protruded toward the internal space of the lamp housing unit 200.

The lateral members 220 cover both sides of the housing member 210 and each include lateral through holes 221 configured to correspond to the respective lateral screws holes 212 of the housing member 210, a plurality of screw taps 222 formed in the outer circumferential surface of the lateral member 220 and spaced apart from one another forwardly and backwardly, and additional screw taps 223 downwardly spaced apart from each other from the screw taps 222 spaced apart from one another forwardly and backwardly.

The lateral screws 230 are screwed onto the respective lateral screws holes 212 in the state in which the lateral screws 230 have penetrated the lateral through holes 221.

The heat dissipation pins 211, the lamp fixing grooves 213, the fitting grooves 216, and the inside support jaws 217 may be formed by cutting and perforation processing in a length direction from one end to the other end if the housing member 210 is made of metal. Accordingly, the housing member 210 can be easily fabricated continuously in the same shape by means of cutting processing. Accordingly, a plurality of the circuit boards 110 on which the LEDs 111 have been mounted can be selectively received in the housing member 210 because the housing member 210 processed by cutting can be cut in various lengths depending on an intention of a user as described above. Furthermore, if the housing member 210 is made of synthetic resin or aluminum, the housing member 210 can be easily extruded and molded. Furthermore, the lateral screws holes 212 can be easily formed at both ends of the housing member 210 by means of drilling.

In particular, the lamp fixing groove 213 includes a plurality of nut support surfaces 214 spaced apart from one another by an interval of both sides symmetrical to each other, of the six surfaces of the nut member 150, and a nut fitting jaw 215 configured to face the nut support surface 214 at the front end of the nut support surface 214, spaced apart from the nut support surface 214 at an interval greater than the diameter of the screw shaft of the bolt member 130 screwed onto the nut member 150, and configured to have the bottom of the nut member 150 seated therein.

Accordingly, the nut member 150 can be inserted into the nut support surface 214 without being rotated because it is inserted into the lamp fixing groove 213 in the state in which both sides of the nut member 150 have been supported by the nut support surface 214. If the bolt member 130 is rotated in such a state, the bolt member 130 can be strongly fastened because the nut member 150 has been fixed to the lamp fixing groove 213. That is, the circuit board 110 can be firmly fixed to the inner side of the housing member 210. Furthermore, the circuit board 110 can be mounted on the housing member 210 easily and rapidly by only inserting the nut member 150 coupled to the bolt member 130 into the lamp fixing groove 213.

Furthermore, the nut support surfaces 214 may be formed at an interval greater than the diameter of the nut member 150. Here, the nut member 150 can be inserted into and fixed to the circuit board 110 in the state in which the bolt member 130 and the nut member 150 have been coupled to the circuit board 110. Furthermore, the nut member 150 is not detached from the lamp fixing groove 213 because both sides of the circuit board 110 are supported by the lateral members 220 fixed to both sides of the housing member 210.

Furthermore, the plurality of lamp fixing grooves 213 may be formed so that the lamp fixing grooves 213 are spaced apart from one another at specific intervals and arrayed in parallel. Accordingly, the circuit board 110 can be further firmly coupled to the housing member 210 because other bolt members 130 and other nut members 150 are fixed to the circuit board 110 and inserted into a plurality of the lamp fixing grooves 213 so that they are spaced apart from the bolt member 130 and the nut member 150 coupled in order to fix the reflectors 120 to the circuit board 110.

The front cover unit 300 includes cover jaws 310 configured to cover the rear and front ends of the housing member 210 in the opened front of the lamp housing unit 200, protrusions 320 detachably fixed to the respective fitting grooves 216 of the lamp housing unit 200 and formed in the inner circumferential surface of the cover jaw 310, and outside support jaws 330 configured to support the outer side of the glass 400 supported by the inside support jaws 217.

Accordingly, the front cover unit 300 can be detachably fixed to the open side of the lamp housing unit 200 because the protrusions 320 are easily fixed to the fitting grooves 216 in a one-touch manner. As a result, the outside support jaws 330 support the outer side of the glass 400 supported by the inside support jaws 217 because the front cover unit 300 is fixed to the lamp housing unit 200 as described above. That is, the glass 400 can remain firmly fixed by means of the inside support jaws 217 and the outside support jaws 330.

The glass 400 may be configured to be transparent in such a way as to transmit light radiated from the lamp unit 100 or may be configured to be semi-transparent for indirect lighting. The glass 400 functions to prevent alien substances from penetrating into the internal space of the lamp housing unit 200.

Figure 8:
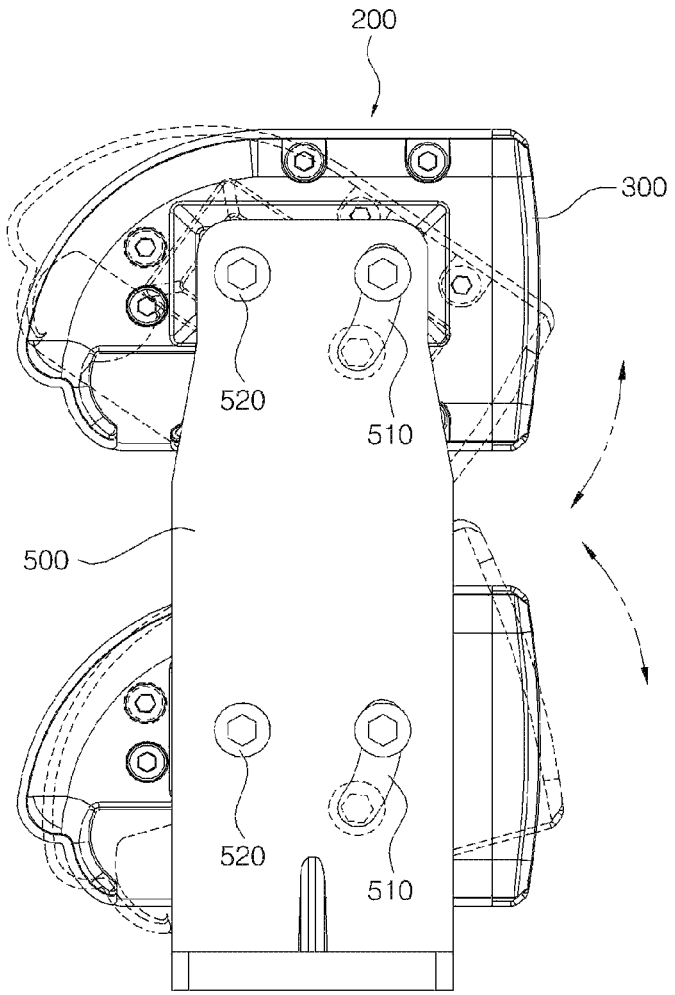
FIG. 8 is a lateral view showing a state in which a radiation angle is controlled by a bracket that is applied to the present invention.

The LED lamp in accordance with the present invention further includes brackets 500 configured to have a plurality of the lamp housing units 200 formed in the bracket 500 and fixed to the bracket 500 in such a manner that angles of the lamp housing units 200 are controlled while being spaced apart from one another up and down, as shown in FIGS. 1 and 8.

Each of the brackets 500 includes a plurality of first lateral communication holes 510, a plurality of second lateral communication holes 520, and a plurality of angle control bolts 530.

The first lateral communication holes 510 are spaced apart from one another forwardly and backwardly and are configured to laterally communicate with the screw taps 222 in such a way as to correspond to the screw taps 222 formed in the lateral members 220 of the lamp housing unit 200 placed on the upper side thereof and to have both ends of the first lateral communication hole 510 on the front side thereof directed upwardly and downwardly and formed in an arc shape.

The second lateral communication holes 520 are spaced apart from one another downwardly from the first lateral communication holes 510 in such a way as to correspond to the respective screw taps 222 formed in the lateral members 220 of the lamp housing unit 200 placed on the lower side and are formed to have the same shapes as the first lateral communication holes 510.

The angle control bolts 530 are screwed onto the screw taps 222 of the lamp housing unit 200 placed on the upper side in such a way as to penetrate the respective first lateral communication holes 510 and are screwed onto the screw taps 222 of the lamp housing unit 200 placed on the upper side in such a way as to penetrate the respective second lateral communication holes 520.

Accordingly, the housing members 210 spaced apart from each other up and down can be fixed to the brackets 500 with the angles of the housing members 210 being controlled by fastening all the angle control bolts 530 on the front and rear sides after controlling the radiation direction of the lamp unit 100 by rotating the housing members 210, spaced apart from each other, up and down around the angle control bolts 530 on the rear side in the state in which the angle control bolts 530 have been screwed onto the screw taps 222 in such a way as to penetrate the first lateral communication holes 510 and the second lateral communication holes 520, but have not been fully fastened.

Since the housing members 210 whose angles have been controlled are fixed to the brackets 500 as described above, the direction of light radiated from the LEDs 111 mounted on the internal spaces of the housing members 210 can be freely controlled up and down. Furthermore, the brackets 500 may be fixed to other structure by bolting.

In particular, a plurality of the lamp housing units 200 may be configured in the state in which the lateral members 220 are installed on both sides of each of the lamp housing units 200 and spaced apart from each other up and down in the brackets 500, so the angles of the lamp housing units 200 can be controlled in the up and down directions.

For example, if the angle of the lamp housing unit 200 on the upper side is controlled upwardly and the angle of the lamp housing unit 200 on the lower side is controlled downwardly, a wide range can be illuminated because the light of the LEDs 111 radiated from the lamp housing units 200 are spread and radiated upwardly and downwardly. Here, when the LEDs 111 embedded in the lamp housing units 200 radiate pieces of light having different colors, different positions can be illuminated with different colors. In contrast, if the lamp housing units 200 placed on the upper and lower sides are directed to or focused on the same direction, pieces of light from the LEDs 111 can be focused on one place.

In accordance with the LED lamp according to the present invention, light diffused by the lens for diffusing light from the LED can be fully reflected from the reflector without being lost outside the lens because the lens can be received in the reflector without interfering with the outer side of the lens.

Furthermore, there is an advantage in that a fine view can be obtained because the elastic protrusions and the fixed holes that are fixed structures for fixing the lens are not exposed in front of the reflector.

Furthermore, there is an advantage in that the time taken to mount the circuit board on which the LEDs have been mounted can be greatly reduced because the circuit board on which the LEDs have been mounted can be inserted into the rectangular lamp fixing grooves formed in the lamp housing and conveniently mounted thereon.

Furthermore, the nut support surface for supporting both sides of the nut member and the nut fitting jaw fitted into the bottom of the nut member are formed in the lamp fixing groove. Accordingly, the circuit board can be installed in the lamp housing easily and rapidly by rotating only the bolt members because the nut member inserted into the lamp fixing groove is not rotated.

Those skilled in the art to which the present invention pertains will understand that the present invention may be implemented in other detailed forms without changing the technical spirit or essential characteristics of the present invention. Accordingly, the aforementioned embodiments should not be construed as being limitative, but should be construed as being only illustrative from all aspects. The scope of the present invention is disclosed in the appended claims rather than the detailed description, and it should be understood that all modifications or variations derived from the meanings and scope of the present invention and equivalents thereof are included in the scope of the appended claims.

What is claimed is:

1. An LED lamp, comprising:

a lamp unit configured to emit light;

a lamp housing unit configured to have the lamp unit embedded in the lamp housing unit and to have a front opened so that the light of the lamp unit is scanned to the front;

a front cover unit fixed in front of the lamp housing unit and configured to have an inside hollowed; and glass fixed in front of the lamp housing unit by means of the front cover unit and configured to transmit the light of the lamp unit, wherein the lamp housing unit comprises fitting grooves formed in an outer circumferential surface of rear and front ends of a housing member in the opened front of the lamp housing unit and inside support jaws configured to support and directly contact an inner side of the glass in a single direction only at the inner side of the glass and protruded toward an internal space of the lamp housing unit, and the front cover unit comprises cover jaws configured to cover the rear and front ends of the housing member in the opened front of the lamp housing unit, protrusions detachably fixed to the respective fitting grooves of the lamp housing unit and formed in an inner circumferential surface of the cover jaw, and outside support jaws configured to support in two directions, at the most, an outer side and an edge side of the glass supported by the inside support jaws, wherein a circumferential edge portion of the glass is configured to be enclosed and supported by the front cover unit.

2. The LED lamp of claim 1, wherein the lamp unit comprises:

a circuit board configured to have LEDs mounted on the circuit board with the LEDs connected to a surface of the circuit board;

reflectors each configured to comprise a reflection surface fixed to the circuit board so that the LED of the circuit board is placed at a rear end of the reflector in such a way as to penetrate the reflector and configured to reflect the light of the LED and a holder mounting hole formed at a front end of the reflection surface;

lenses each inserted into the reflector and configured to diffuse the light of the LED with the lens closely adhered to the LED; and holders each inserted into the holder mounting hole of the reflector in a state in which the holder pressurizes a front end of the lens in order to prevent the lens from being detached from the reflector and configured to reflect the light of the LED which is diffused by the lens along with the reflector.

3. The LED lamp of claim 2, wherein:

the holder comprises elastic protrusions formed in an outer circumferential surface of the holder, and the reflector comprises fixed holes configured to have the elastic protrusions of the holder detachably fixed to the fixed holes and formed in the holder mounting hole in such a way as to laterally penetrate the holder mounting hole.

4. The LED lamp of claim 2, wherein reflection paints are coated on an inner circumferential surface of the holder.

5. The LED lamp of claim 2, further comprising:

board screw taps formed in the circuit board in such a way as to penetrate the circuit board;

bolt members each screwed onto a board screw tap of the circuit board so that the reflector is installed in the circuit board;

bolt reception tubes each configured to have the bolt member inserted into the bolt reception tube from an inside to an outside of the reflector so that the bolt member communicates with the bolt reception tube and to comprise a shaft hole configured to have a screw shaft of the bolt member penetrate through the shaft hole and a bolt jaw configured to have a head of the bolt member fitted into the bolt jaw and formed on an outside of the shaft hole; and nut members each configured to penetrate the shaft hole of the bolt reception tube and fixed to the lamp housing unit screwed onto a screw shaft of the bolt member screwed onto the board screw tap of the circuit board.

6. The LED lamp of claim 2, wherein the lamp unit further comprises a socket fixing plate configured to have fronts of two or more reflectors fixed to the socket fixing plate in such a way as to penetrate the socket fixing plate.

7. The LED lamp of claim 1, wherein the lamp housing unit comprises:

a housing member configured to extend along with the opened front, to have an internal space formed in the housing member, and to comprise heat dissipation pins backwardly protruded from the housing member, lateral screw holes configured to have female threads formed on a side of the housing member, and lamp fixing grooves formed laterally from the housing member and configured to have a nut members inserted into and fixed to the lamp fixing grooves;

lateral members configured to cover both sides of the housing member and each configured to comprise lateral through holes configured to correspond to the respective lateral screws holes of the housing member and a plurality of screw taps formed in an outer circumferential surface of the lateral member and spaced apart from one another forwardly and backwardly; and lateral screws screwed onto the lateral screws holes in a state in which the lateral screws have penetrated the lateral through holes.

8. The LED lamp of claim 7, wherein each of the lamp fixing grooves comprises:

a plurality of nut support surfaces spaced apart from one another by an interval of both sides that are symmetrical to each other, of six surfaces of the nut member; and a nut fitting jaw configured to face the nut support surface at a front end of the nut support surface, spaced apart from the nut support surface at an interval greater than a diameter of a screw shaft of the bolt member screwed onto the nut member, and configured to have a bottom of the nut member seated in the nut fitting jaw.

9. The LED lamp of claim 7, further comprising brackets configured to have a plurality of the lamp housing units formed in the bracket and fixed to the bracket in such a manner that angles of the lamp housing units are controlled while being spaced apart from one another up and down, wherein each of the brackets comprises:

a plurality of first lateral communication holes spaced apart from one another forwardly and backwardly and configured to laterally communicate with the screw taps in such a way as to correspond to the screw taps formed in the lateral members of the lamp housing unit placed on an upper side and to have both ends of the first lateral communication hole on a front side directed upwardly and downwardly and formed in an arc shape;

second lateral communication holes spaced apart from one another downwardly from the first lateral communication holes in such a way as to correspond to the respective screw taps formed in the lateral members of the lamp housing unit placed on a lower side and formed to have an identical shape as the first lateral communication holes; and angle control bolts screwed onto the screw taps of the lamp housing unit placed on an upper side in such a way as to penetrate the respective first lateral communication holes and screwed onto the screw taps of the lamp housing unit placed on the upper side in such a way as to penetrate the respective second lateral communication holes.

* * * * *